US009701500B2

(12) United States Patent
Sugaya et al.

(10) Patent No.: US 9,701,500 B2
(45) Date of Patent: Jul. 11, 2017

(54) SHEET CONVEYING APPARATUS AND IMAGE FORMING APPARATUS

(71) Applicant: CANON KABUSHIKI KAISHA, Tokyo (JP)

(72) Inventors: Kenjiro Sugaya, Moriya (JP); Osamu Sugino, Abiko (JP); Hiroki Muramatsu, Tokyo (JP); Masahiro Tsujibayashi, Nagareyama (JP); Michiaki Endo, Abiko (JP); Teppei Nagata, Abiko (JP); Rikiya Takemasa, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/877,039

(22) Filed: Oct. 7, 2015

(65) Prior Publication Data

US 2016/0101952 A1 Apr. 14, 2016

(30) Foreign Application Priority Data

Oct. 10, 2014 (JP) ..... 2014-208959

(51) Int. Cl.
*B65H 5/06* (2006.01)

(52) U.S. Cl.
CPC ..... *B65H 5/06* (2013.01); *B65H 5/062* (2013.01); *B65H 2301/511* (2013.01); *B65H 2301/51232* (2013.01); *B65H 2601/51* (2013.01)

(58) Field of Classification Search
CPC . B65H 5/06; B65H 5/062; B65H 5/36; B65H 29/12; B65H 29/125; B65H 29/52; B65H 2511/16; B65H 2511/162; B65H 2515/80; B65H 2601/2531; B65H 2701/131; B65H 271/1315; B65H 2301/51232; B65H 2301/511; B65H 2601/51
USPC ..... 271/264, 272
See application file for complete search history.

(56) References Cited

U.S. PATENT DOCUMENTS

| | | | | |
|---|---|---|---|---|
| 7,424,261 | B2 | 9/2008 | Uchida et al. | |
| 2012/0183338 | A1* | 7/2012 | Kanai | B65H 5/062 399/361 |
| 2013/0043650 | A1 | 2/2013 | Hatazaki | |
| 2013/0241146 | A1* | 9/2013 | Takai | G03G 15/6567 271/273 |
| 2014/0030000 | A1 | 1/2014 | Gamo et al. | |

(Continued)

FOREIGN PATENT DOCUMENTS

| | | | |
|---|---|---|---|
| JP | 10-218459 | A | 8/1998 |
| JP | 2009-198682 | A | 9/2009 |
| JP | 2013-41210 | A | 2/2013 |

OTHER PUBLICATIONS

Machine translation of Japanese 2009-198682 Shirai.*

*Primary Examiner* — David H Bollinger
(74) *Attorney, Agent, or Firm* — Fitzpatrick, Cella, Harper & Scinto

(57) ABSTRACT

A sheet conveying apparatus includes a sheet conveying path through which a sheet is conveyed, and a burr pushing portion provided on the sheet conveying path and pushing down a burr, formed at one side edge in a width direction orthogonal to a sheet conveying direction of the sheet, in the width direction. The burr pushing portion includes a contact portion coming into contact with the burrs while inclining with respect to the side edge of the sheet conveyed thereto.

4 Claims, 16 Drawing Sheets

(56) References Cited

U.S. PATENT DOCUMENTS

| | | | |
|---|---|---|---|
| 2014/0205317 | A1 | 7/2014 | Takematsu et al. |
| 2015/0042032 | A1 | 2/2015 | Abe et al. |
| 2015/0115527 | A1 | 4/2015 | Takematsu et al. |
| 2015/0232293 | A1 | 8/2015 | Sugaya et al. |
| 2015/0316877 | A1 | 11/2015 | Okuda et al. |
| 2015/0316890 | A1 | 11/2015 | Okuda et al. |

* cited by examiner

SHEET CONVEYING APPARATUS AND IMAGE FORMING APPARATUS

BACKGROUND OF THE INVENTION

Field of the Invention

The present invention relates to a sheet conveying apparatus and to an image forming apparatus including the same.

Description of the Related Art

In general, an image forming apparatus includes a transfer portion transferring a toner image onto a sheet and a fixing portion having a heating and pressure roller pair disposed downstream in a sheet conveying direction of the transfer portion. The sheet onto which the toner image has been transferred at the transfer portion and fixed by being nipped through the heating and pressure roller pair is then conveyed and discharged out of the apparatus.

The sheet of the type used in the image forming apparatus is normally manufactured by cutting a long and wide base sheet into sheets of predetermined size. There is a case when burr is generated on a cut surface of the sheet cut as described above depending on a cutting method, a cutting device, and cutting history of a cutter. While the burr on the cut surface of the sheet is generated on a sheet edge warping toward a side in which a movable blade is pulled out, a magnitude, a direction and a shape of the burr are different depending on a sheet size and a manufacturing lot and are not always constant.

When a large number of such sheets in which the burr is formed at the sheet edge is conveyed consecutively to the transfer portion or the fixing portion, there is a case when a transfer member such as a transfer roller and a fixing member such as a heating and pressure roller pair are scratched by the burr at the sheet edge. Then, due to the scratch of the heating and pressure roller pair, there is a case when stripes, flaws or unevenness are generated on the image fixed on the sheet. For instance, if a large-size sheet is fixed after consecutively fixing a large number of small-size sheets by the heating and pressure roller pair, there is a case when such stripes, flaws or unevenness are generated on the image fixed on the large-size sheet due to the scratches of the heating and pressure roller pair caused in fixing the small-size sheets. There is a problem that quality of the image on the sheet drops if the heating and pressure roller pair is thus scratched.

As a solution for the scratch of the heating and pressure roller pair caused by the burr, Japanese Patent Application Laid-open No. Hei. 10-218459 for example discloses a technology of correcting the burr by providing a burr correcting portion having a certain irregular shape between a feed roller and a registration roller. That is, according to this technology, the burr correcting portion is composed of a pair of rollers and conveys while pressing a sheet such that a condition of a front edge of the sheet passing through the roller pair is leveled. For example, fine irregularities are formed on surfaces of the roller pair along a sheet feed direction while shifting positions of the irregularities of the roller pair from each other so as to engage and to crush the burr at the front end of the sheet.

Still further, Japanese Patent Application Laid-open No. 2009-198682 discloses a technology of disposing a burr removing portion having a movable removing brush upstream in a sheet conveying direction of a transfer portion and of removing burrs by increasing a rotation speed of the removing brush more than a sheet conveying speed. That is, this technology removes the burrs at side edges of a sheet conveyed through a sheet conveying path by bringing the removing brush disposed on the sheet conveying path upstream in the sheet conveying direction of the transfer portion into contact with the sheet side edges.

Japanese Patent Application Laid-open No. 2013-41210 discloses a technology of disposing a metallic roller pair for crushing burrs of a sheet and of removing the burrs by applying a pressure of about 450 [kgf] in an entire longitudinal direction of the sheet.

However, the burr removing methods described in Japanese Patent Application Laid-open Nos. Hei. 10-218459 and 2009-198682 may possibly cause a large amount of paper powders on the sheet and lower the burr removing functions because the removed paper powders accumulate on a removing portion. It is noted that the 'paper powders' include both plant fiber paper powders and powders other than the plant fiber paper powders. Still further, according to the burr removing method described in Japanese Patent Application Laid-open No. 2013-41210, it is necessary to apply an extremely large force on the sheet edge part to crush the burrs, so that a torque of a sheet conveying driving roller may possibly be increased. Meanwhile, while there is an apparatus configured to remove paper powders by blowing air within a sheet conveying apparatus, such configuration may possibly increase a size and a cost of the apparatus.

SUMMARY OF THE INVENTION

According to one aspect of the invention, a sheet conveying apparatus includes a sheet conveying path through which a sheet is conveyed, and a burr pushing portion provided on the sheet conveying path and pushing down a burr, formed at one side edge in a width direction orthogonal to a sheet conveying direction of the sheet, in the width direction.

Further features of the present invention will become apparent from the following description of exemplary embodiments with reference to the attached drawings.

DESCRIPTION OF THE EMBODIMENTS

First Embodiment

Figure 1:
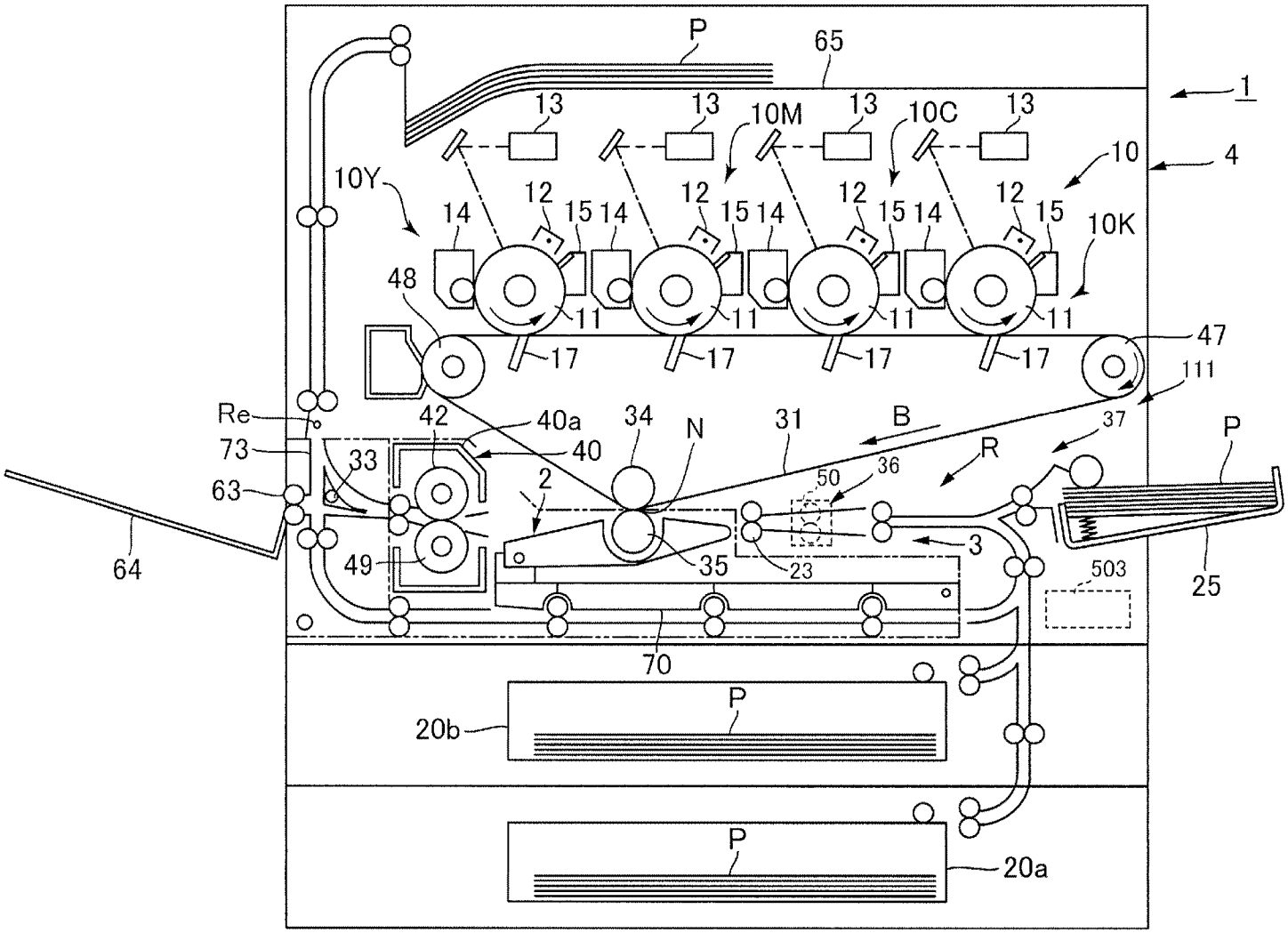
FIG. 1 is a section view illustrating a schematic configuration of an image forming apparatus of the invention.

Embodiments of the present invention will be described below with reference to the drawings. At first, a first embodiment of the invention will be described. FIG. 1 is a section view illustrating a schematic configuration of a color electro-photographic printer, i.e., one exemplary image forming apparatus, of the embodiment, viewed in a direction orthogonal to a sheet conveying direction. The color electro-photographic printer will be referred to simply as a 'printer' hereinafter.

As shown in FIG. 1, the printer (image forming apparatus) 1 includes a printer body (apparatus body) 4, and the printer body 4 includes image forming portions 10Y, 10M, 10C, and 10K (referred simply as 'image forming portions 10Y through 10Bk' or as an 'image forming portion 10' hereinafter) respectively corresponding to four colors of yellow (Y), magenta (M), cyan (C), and black (Bk). The printer body 4 also includes a control portion 503 having a CPU, a RAM, and a ROM. Each image forming portion 10 corresponding to each color includes a photosensitive drum 11, and a charger 12, a laser scanner 13, a developer 14, a primary transfer blade 17, and a cleaner 15 disposed along a direction of rotation of the photosensitive drum 11.

In each image forming portion 10, an electrostatic latent image is formed by the laser scanner 13 on the photosensitive drum 11 being charged in advance by the charger 12 and is visualized by the developer 14 as a toner image. The toner images formed on the respective photosensitive drums 11 are transferred sequentially onto an intermediate transfer belt 31, i.e., an image bearing member, by the primary transfer blade 17. After the transfer, toner left on the photosensitive drum 11 is removed by the cleaner 15, so that the surface of the photosensitive drum 11 is cleaned and is ready to form a next image. Based on image data transmitted from another apparatus or read from a storage device not shown, each image forming portion 10 forms the image onto a sheet P conveyed through a sheet conveying path R by a sheet conveying apparatus 37.

Meanwhile, the sheet P fed one by one from a first or second sheet feed cassette 20*a* or 20*b* or from a multi-feed tray 25 provided on one side of the printer 1 is sent to a registration roller pair 23. The registration roller pair 23 once receives the sheet P and corrects a skew thereof. Then, in synchronism with the toner image on the intermediate transfer belt 31, the registration roller pair 23 sends the sheet P to a secondary transfer nip portion N between the intermediate transfer belt 31 and a secondary transfer roller 35. The intermediate transfer belt 31 is supported by tension rollers 47, 48, and 34 such that the belt 31 rotates in a direction of an arrow B. The sheet P is conveyed to the secondary transfer nip portion N through the sheet conveying path R.

The color toner image on the intermediate transfer belt 31 is transferred by the secondary transfer roller 35 onto the sheet P, and the sheet P on which the toner image has been transferred is guided by a pre-fixing guide 2 to a fixing apparatus 40. Subsequently, the toner image on the sheet P is fixed by being heated and pressed by the fixing apparatus 40 having an image heating belt (endless belt) 42 and a pressure roller 49 stored within a casing 40*a*. Specifically, the sheet on which the toner image is fixed may be exemplified by a plain sheet, a resin-made sheet, i.e., a substitute for the plain sheet, a thick sheet, an overhead projector sheet, or the like.

In the case of forming a toner image on one face of the sheet P, a conveying path is switched by a switching member 33 corresponding to a certain condition. That is, in a case of discharging the sheet P in a face-up condition (the toner image faces upward), the sheet P is discharged to a discharge tray 64 disposed on a side surface of the printer 1 through a discharge roller 63. Meanwhile, in a case of discharging the sheet P in a face-down condition (the toner image faces downward), the sheet P is discharged to a discharge tray 65 disposed at an upper part of the printer 1.

In a case of forming toner images on both faces of the sheet P, the sheet P on which the toner image has been fixed by the fixing apparatus 40 is guided upward by the switching member 33 and when a rear end thereof reaches a reverse point Re, the sheet P is switched back and conveyed through a switch-back conveying path 73. Thereby, the front and back faces of the sheet P are reversed. Then, the sheet P is conveyed through a duplex conveying path 70, and a toner image is formed on another face through processes similar to those in forming an image on one face. Then, the sheet P is discharged to the discharge tray 64 or the discharge tray 65. It is noted that an image forming unit 111 forming the image on the sheet P conveyed by the sheet conveying apparatus 37 is composed of the image forming portion 10, the secondary transfer nip portion (transfer portion) N, and the fixing apparatus 40.

[Burr of Sheet]

Figure 2:
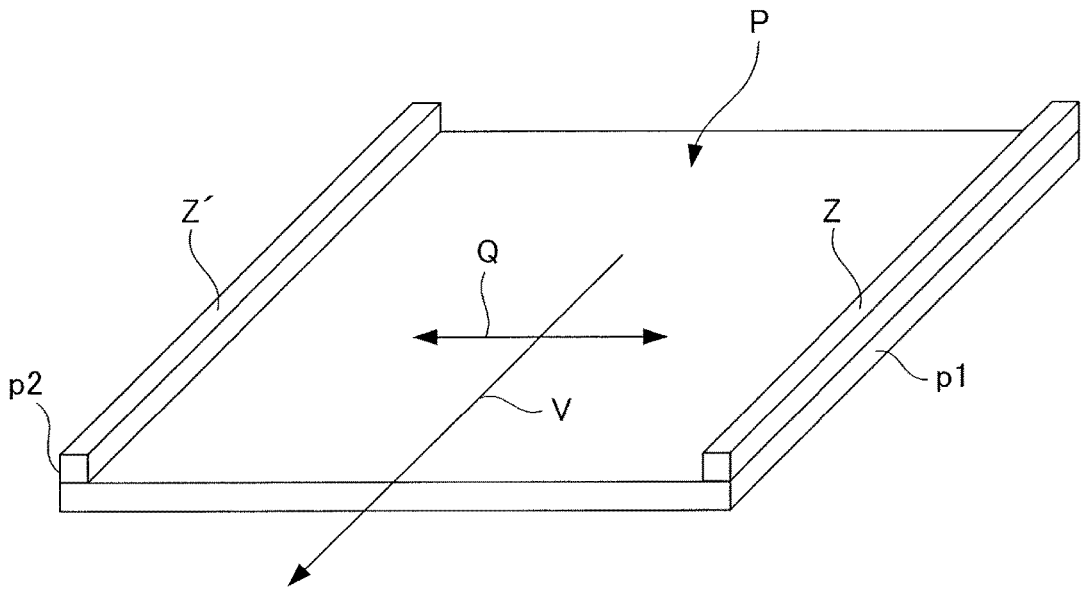
FIG. 2 is a perspective view explaining burrs on a sheet.

By the way, a burr is generated on a cut face of the sheet P depending on a cutting method, a cutting device, and difference of cutting history of a cutter. FIG. 2 is a perspective view explaining the burrs generated on the sheet P.

The burrs generated at edges of the sheet P in FIG. 2 are generated when the sheet P is cut by a fixed blade and a movable blade of a cutter of a cutting device not shown. The burr is formed when the sheet edge warps to a side in which the movable blade is pulled. Size of the burr is different depending on a type of the cutting device and on the cutting history (number of cut sheets) of the cutter, and directions and shapes of the burr are different even in one sheet P. Still further, form of the burr changes depending on a type of the sheet P and on a lot of the sheet P.

As shown in FIG. 2, the burrs of the sheet P are possibly formed at four sides of the sheet P. The burrs at a front end (downstream edge in a sheet conveying direction, i.e., a direction of an arrow V in FIG. 2) of the sheet P and at a rear end (upstream edge in the sheet conveying direction) are less possible to cause scratches on the intermediate transfer belt 31 and in the fixing apparatus 40. However, burrs Z and Z' on side edges of the sheet in a width direction orthogonal to the sheet conveying direction (direction of an arrow Q in FIG. 2: referred to as a 'width direction' hereinafter) are more possible to cause scratches on the intermediate transfer belt 31 and in the fixing apparatus 40 because a time during which the burrs are in pressure contact with the intermediate transfer belt 31 and the fixing apparatus 40 is longer than that of the front and rear edges of the sheet.

Then, according to the present embodiment, as shown in FIG. 1, the printer 1 is provided with a burr pushing device 36 having a burr pushing roller pair 50, i.e., a burr pushing portion pushing down the burrs of the sheet so as to flatten the burrs, upstream of the secondary transfer nip portion N (transfer portion) composed of the secondary transfer roller 35. It is noted that it is also possible to use a Mylar sheet as the burr pushing portion.

[Burr Falling Device]

Figure 3A:
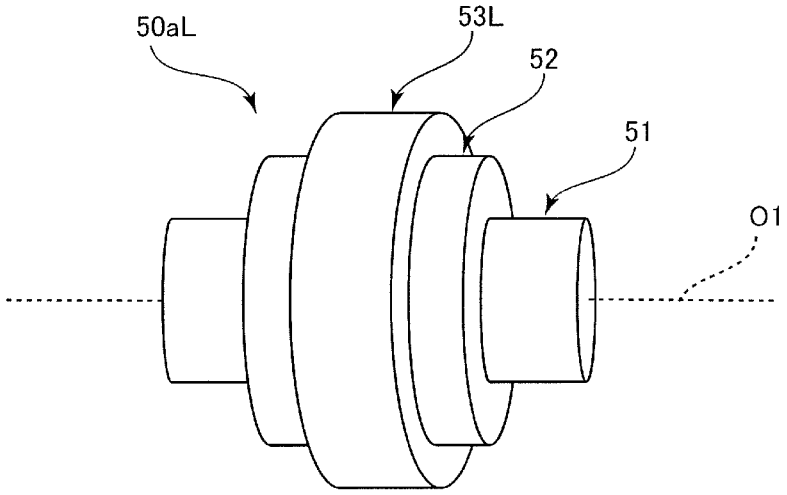
FIG. 3A is a perspective view illustrating a burr pushing roller.
Figure 3B:
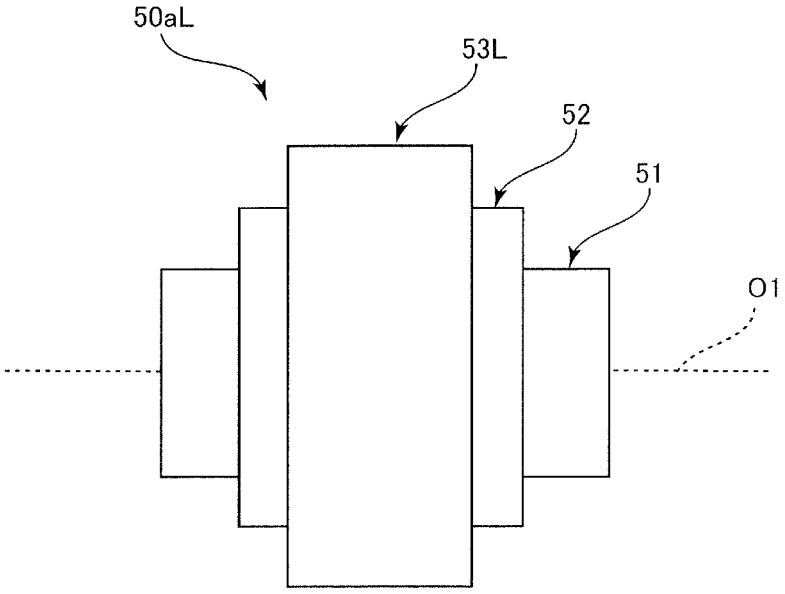
FIG. 3B is a front view illustrating the burr pushing roller.

Next, the burr pushing roller pair 50 provided in the burr pushing device 36 of the present embodiment will be described in detail with reference to FIGS. 3A through 5B. It is noted that FIG. 3A is a perspective view illustrating a burr pushing roller 50*a*L of the present embodiment, FIG. 3B is a front view illustrating the burr pushing roller 50*a*L, FIG. 4A is a perspective view illustrating a burr pushing roller pair 50L, FIG. 4B is a side view illustrating the burr pushing roller pair 50L viewed from an axial direction thereof, FIG. 5A is a plan view diagrammatically illustrating positional relationships between the sheet P and the burr pushing rollers 50*a*L and 50*a*R, and FIG. 5B is an enlarged plan view illustrating a condition of the burr pushing roller 50*a*L disposed with respect to the side edge p2 of the sheet.

Figure 5A:
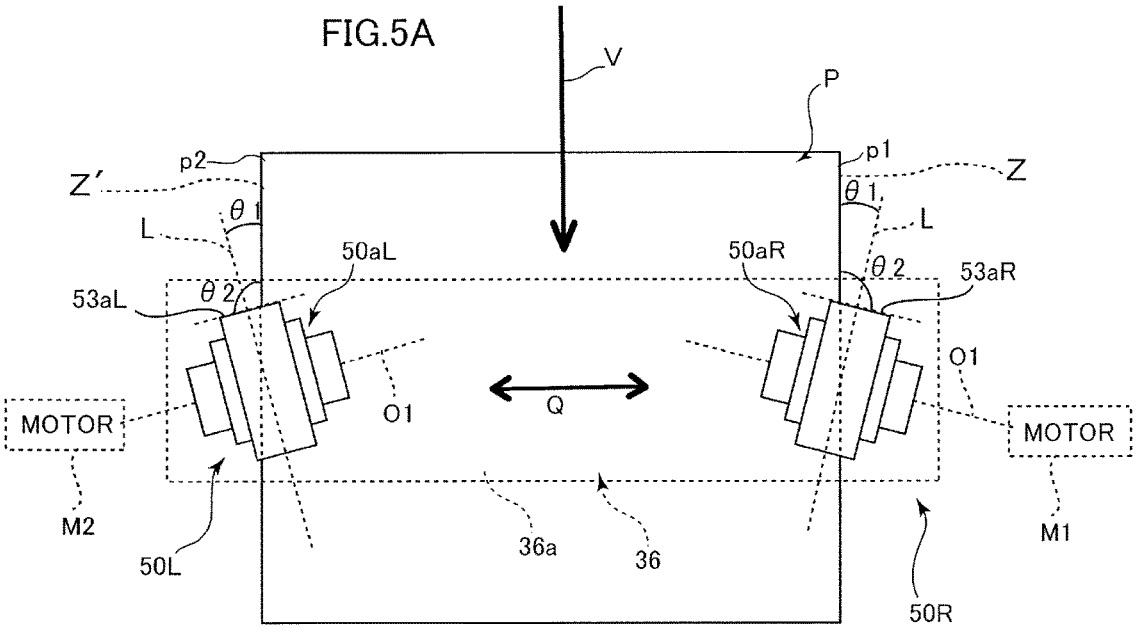
FIG. 5A is a plan view diagrammatically illustrating positional relationships between the sheet and the burr pushing rollers.

As shown in FIG. 5A, the burr pushing device 36 includes a set of burr pushing roller pairs 50R and 50L disposed on widthwise both sides of the sheet conveying path R. The burr pushing roller pairs 50R and 50L are supported so as to approach and separate from each other in a width direction (direction of an arrow Q) by a casing 36*a*, i.e., an apparatus body of the burr pushing device 36. It is noted that the burr pushing roller pair 50R on a right-hand side in FIG. 5A is constructed similarly to the burr pushing roller pair 50L on a left-hand side, only the burr pushing roller pair 50L will be described below and a description of the burr pushing roller pair 50R will be omitted here.

Figure 4A:
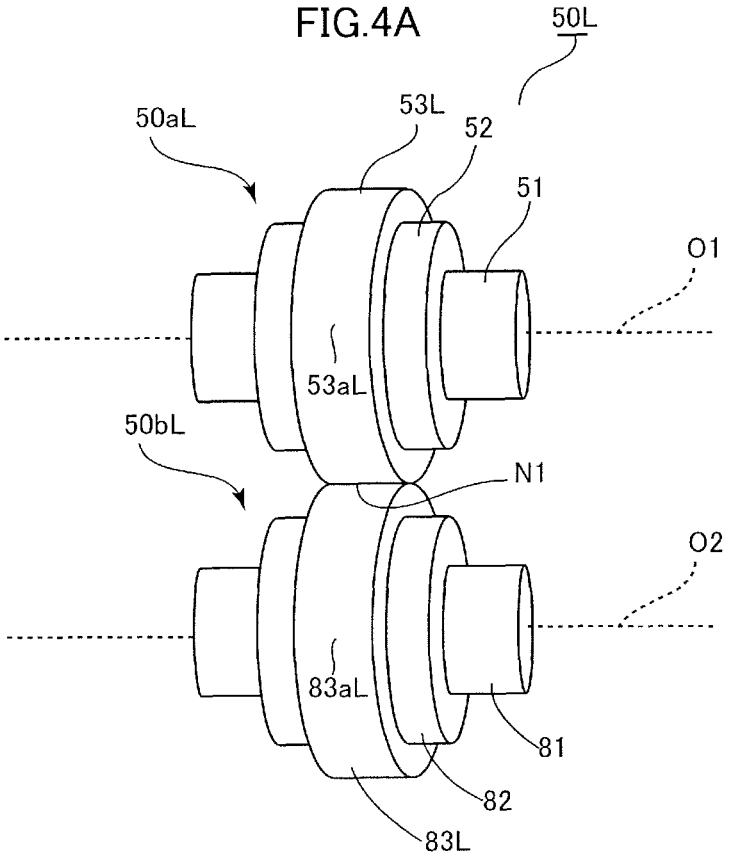
FIG. 4A is a perspective view illustrating a burr pushing roller pair.
Figure 4B:
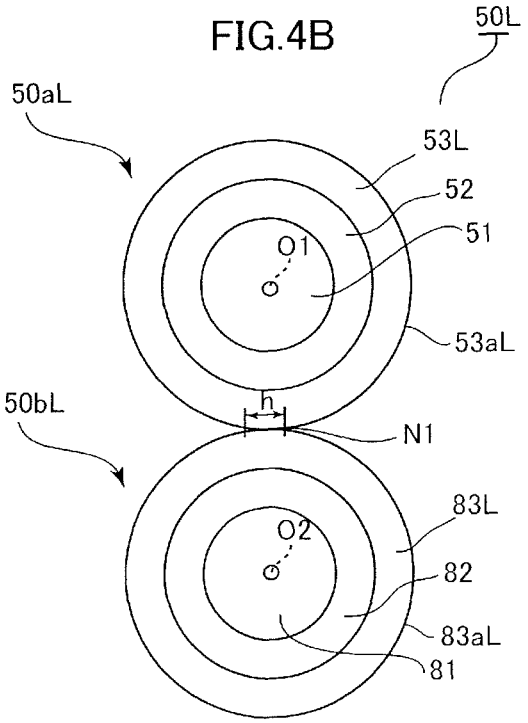
FIG. 4B is a side view illustrating the burr pushing roller pair viewed from an axial direction thereof.
Figure 5B:
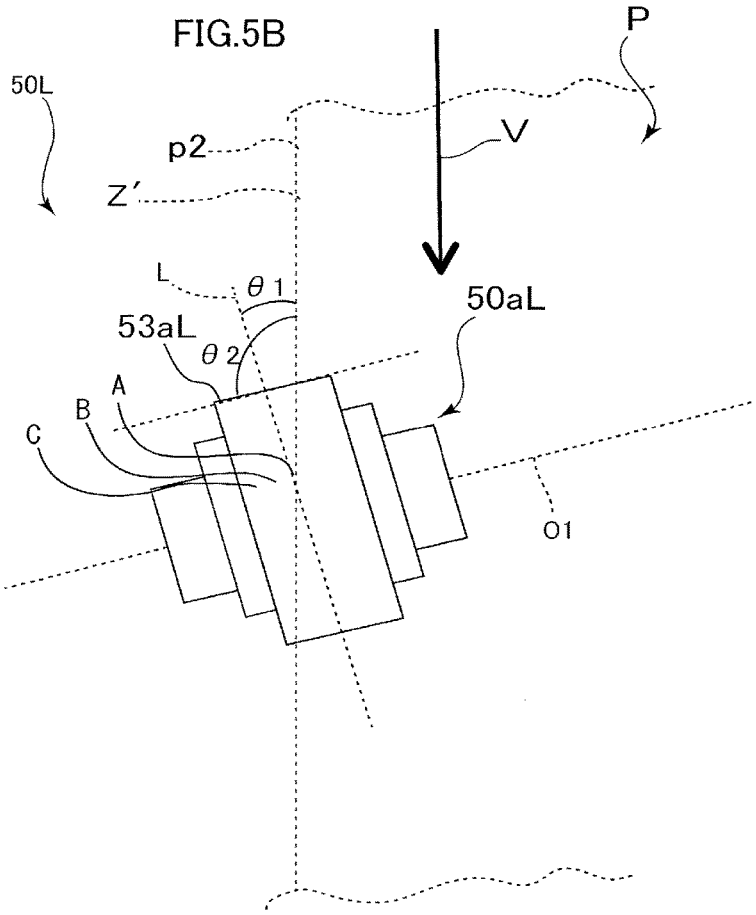
FIG. 5B is an enlarged plan view illustrating the burr pushing roller disposed with respect to a side edge of the sheet.

As shown in FIGS. 4A and 4B, the burr pushing roller pair 50L includes a pair of burr pushing rollers 50*a*L and 50*b*L supported so as to face and to be in contact with each other. Because the burr pushing rollers 50 *a*L and 50*b*L are in contact with each other, a burr pushing nip portion N1 is formed. The burr of the sheet P is pushed at the burr pushing nip portion N1 such that the surface of the sheet P is leveled as described later.

As shown in FIGS. 3A and 3B and FIGS. 4A and 4B, the burr pushing roller 50*a*L (a burr pushing portion, first burr pushing portion, first roller) is composed of an axial member 51, an axial member 52 whose diameter is larger than that of the axial member 51, and an elastic layer 53L formed around an outer circumferential surface of the axial member 52. The axial members 51 and 52 are made of a SUS (stainless steel) member, and the elastic layer 53L is made of silicon rubber. The axial members 51 and 52 and the elastic layer 53L have respective outer circumferential surfaces concentrically centering on an axis of rotation O1, e.g., an outer circumferential surface 53*a*L of the elastic layer 53L, and the burr pushing roller 50*a*L rotates centering on the axis of rotation O1.

A lower burr pushing roller 50*b*L is constructed in the same manner with the upper burr pushing roller 50*a*L and includes axial members 81 and 82 and an elastic layer 83. The lower burr pushing roller 50 bL is in contact with the upper burr pushing roller 50*a*L and is driven centering on an axis of rotation O2.

As shown in FIGS. 5A and 5B, the burr pushing roller 50*a*R (second burr pushing portion, second roller) in the right burr pushing roller pair 50R is rotationally driven by a motor M1, and the burr pushing roller 50*a*L in the left burr pushing roller pair 50L is rotationally driven by a motor M2. Still further, the burr pushing roller pairs 50L and 50R approach and separate widthwise from each other by being driven by a motor M3 (see FIG. 8) as described later. As for a rotational direction of the burr pushing roller pairs 50R and 50L (the burr pushing rollers 50*a*R and 50*a*L) rotated by the motors M1 and M2, it is possible to obtain a burr pushing effect even if the rotational direction is a normal direction in which the rollers are rotated along with the sheet conveying direction (direction of an arrow V) or is a reverse direction in which the rollers are rotated reversely to the sheet conveying direction.

However, it is possible to obtain a better burr pushing effect by rotating in the reverse direction. This point is the same also in a second embodiment described later. It is noted that in the case of the configuration in which the burr pushing roller pairs 50R and 50L are rotated in the reverse direction, pressure of a nip between the burr pushing rollers 50*a*L and 50*b*L is set to be smaller than that in the normal direction so as not interfere the conveyance of the sheet P.

Here, a positional relationship and others of the upper burr pushing rollers 50*a*R and 50*a*L of the burr pushing roller pairs 50R and 50L with the sheet P will be described with reference to FIGS. 5A and 5B. The upper and lower burr pushing rollers are constructed in the same manner with each other and are disposed so as to face in a same direction in a plan view in the present embodiment, so that the burr pushing rollers 50*a*R and 50*a*L located above the sheet P will be described below.

The respective burr pushing rollers 50*a*R and 50*a*L are disposed on both sides in the width direction (Q) orthogonal to the sheet conveying direction (V) of the sheet conveying path R, as follows. That is, the respective burr pushing rollers 50*a*R and 50*a*L are disposed so as to push down the burrs Z and Z', formed at the sheet side edges p1 and p2 of a sheet conveyed through the sheet conveying path R, to the outside of the sheet conveying path R in the width direction for flattening the burrs Z and Z' by rotating such that the respective outer circumferential surfaces (contact portions) 53*a*R and 53*a*L are in contact while intersecting respectively with one and other side edges p1 and p2 of the sheet. That is, the respective burr pushing rollers 50*a*R and 50*a*L are disposed so as to push down the burrs Z and Z' in the width direction (Q) by bringing the respective outer circumferential surfaces 53*a*R and 53*a*L in contact while intersecting respectively with the one and other side edges p1 and p2 of the sheet P.

More specifically, as shown in FIG. 5A, the respective burr pushing rollers 50*a*R and 50*a*L are disposed such that the outer circumferential surfaces 53*a*R and 53*a*L (second and first outer circumferential surfaces) can be in contact with the side edges p1 and p2 of the sheet P while inclining to the outside of the sheet conveying path R by a predetermined angle θ2 with respect to the side edges p1 and p2 of the sheet P conveyed thereto. In other words, the respective burr pushing rollers 50*a*L and 50*a*R are disposed such that the axes of rotation O1 are inclined upstream of the sheet conveying direction (V) as it heads to the sheet conveyance center. Still further, the respective burr pushing rollers 50$a$L and 50$a$R are disposed while inclining aslant such that the outer circumferential surfaces 53$a$L and 53$a$R approach the center of the sheet conveying path R along from an upstream side toward a downstream side in the sheet conveying direction. The relative positional relationships between the sheet P conveyed thereto and the respective burr pushing rollers 50$a$R and 50$a$L are set such that they come into contact as described above.

As shown in FIG. 5A, the burr pushing rollers 50$a$R and 50$a$L are also disposed as follows. That is, the burr pushing rollers 50$a$R and 50$a$L are disposed such that the positions where the outer circumferential surfaces 53$a$R and 53$a$L come into contact with the burrs Z and Z' of the side edges p1 and p2 of the sheet conveyed thereto gradually move to the outside (widthwise) of the sheet conveying path R as the sheet P passes by. Specifically, as shown in FIG. 5B, the burrs Z' of the other side edge p2 are sequentially pushed down in the width direction (Q) by the outer circumferential surface 53$a$L inclined outward while moving in the direction of the arrow V, and the position of contact with the outer circumferential surface 53$a$L is gradually moved from a point A to a point B and from the point B to a point C for example.

Thereby, because the burrs Z' which have erected to a front side of FIG. 5B upstream in the sheet conveying direction are pushed outward, i.e., in the width direction, while gradually moving the positions of contact with the outer circumferential surface 53$a$L, the burrs Z' are pushed to a same level with another flat surface of the sheet P. Due to that, the possibility of causing scratches on the belt and the roller of the intermediate transfer belt 31 and the fixing apparatus 40 is considerably reduced. It is noted that while the process of sequentially pushing down the burrs in the width direction by the outer circumferential surfaces 53$a$R and 53$a$L of the upper burr pushing rollers 50$a$R and 50$a$L of the burr pushing roller pairs 50R and 50L has been described above, this process is applicable also to the outer circumferential surfaces 83$a$L (see FIG. 4) of the lower burr pushing rollers 50$b$R and 50$b$L in the same manner. Therefore, it is possible to obtain the burr pushing effect similarly on the upper and lower sides of the sheet surface even if the burrs Z and Z' of the side edges p1 and p2 of the sheet face either side of the upper and lower sides of the sheet surface. It is noted that the same operational effect as described above is brought about in the right and left burr pushing roller pairs 50L and 50R.

Figure 16:
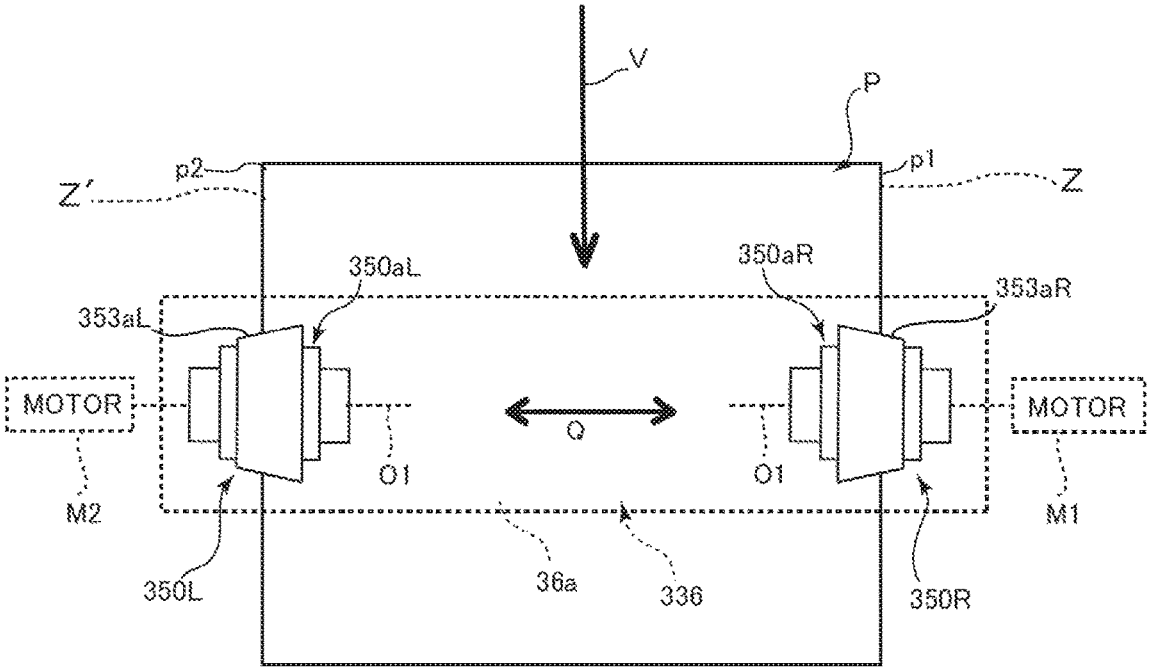
FIG. 16 is a plan view illustrating rollers of an alternate embodiment having an outer circumferential surface which decreases along the width direction.

It is noted that the burr pushing roller constructed such that the position of contact with the burrs is gradually moved to the outside of the sheet conveying path R as the sheet passes by as described above is not limited to the cylindrical roller of the present embodiment. For instance, it is also possible to realize the same operational effect by disposing a conical or head-cut conical roller (referred to as a 'trapezoidal roller' hereinafter) such that a small-diameter side of the cone orients the outside of the sheet conveying path R and such an axis of rotation is paralleled with the width direction (Q). An outer circumferential surface of this trapezoidal roller comes into contact aslant with burrs formed at the side edge of the sheet in view of the sheet conveying direction. This embodiment is illustrated in FIG. 16, where reference numerals 353$a$L, 353$a$R, 350L, 350R, 350$a$L and 350$a$R correspond to reference numerals 53L, 53R, 50L, 50R, 50$a$L and 50$a$R of the first embodiment, respectively.

While a radius of the outer circumferential surface (contact portion) of the trapezoidal roller is reduced widthwise in a direction from the sheet conveyance center to the outside, it is also possible to configure such that the radius increases in the direction from the sheet conveyance center to the outside. In this case, the burrs formed at the side edge of the sheet are pushed down to the side of the sheet conveyance center (inward).

Still further, while the burr pushing rollers 50$a$R and 50$a$L, i.e., the burr pushing roller pairs 50R and 50L, are disposed on the both sides of the width direction (Q) of the sheet conveying path in the present embodiment, the present invention is not limited to such configuration. That is, it is possible to dispose the burr pushing roller just one side of the width direction. In such a case, the burr pushing process is implemented only on one side edge of the sheet P. This is applicable also to the second embodiment described later.

As described above, the respective burr pushing rollers 50$a$R and 50$a$L are composed of the cylindrical rollers rotationally driven while in contact with the side edges p1 and p2 of the sheet P conveyed thereto. The burr pushing rollers 50$a$R and 50$a$L are supported while inclining by a predetermined angle θ2 such that the outer circumferential surface approaches the center of the sheet conveying path R along from the upstream side toward the downstream side of the sheet conveying direction in a plan view. The burr pushing rollers 50$a$R and 50$a$L are supported such that the axes of rotation O are inclined outward by the predetermined angle θ2 toward the downstream in the sheet conveying direction (V) with respect to a direction in which the sheet conveying path R extends (in a vertical direction in FIG. 5A).

[Inclination Angle of Burr Pushing Roller]

Now, results obtained from experiments conducted on the burr pushing effect exerted by an angle θ1 formed between a line L orthogonal to the axis of rotation O1 of the burr pushing rollers 50$a$R and 50$a$L (i.e., the outer circumferential surfaces 53R and 53L) and the side edges p1 and p2 of the sheet P will be described. The angle θ2 described above is an angle in which 90° is added to the angle θ1. It is noted that while the following experiments have been carried out on the left burr pushing roller 50$a$L, same experimental results are obtained also on the right burr pushing roller 50$a$R.

A sheet conveying speed is set at 200 mm/s and a rotational speed of the burr pushing roller 50$a$L is set at 200 mm/s as experimental conditions. Still further, a nip width h of the burr pushing nip portion N1 (see FIG. 4A) of the burr pushing roller pair 50L is set at 8 mm (see FIG. 4B), and a pressurizing force between the burr pushing roller 50$a$L and 50$b$L is set at 0.01 MPa. It is noted that the nip width h in FIG. 4B is a length in the sheet conveying direction of a crushed part of the burr pushing nip portion N1.

The burr pushing effect and an influence on wrinkles of the sheet of the burr pushing roller pair 50L has been studied while changing the angle θ1 in a range from 0° to 90° in the experiment. Still further, a type of the sheet P used was GF-0081 (manufactured by Nippon Paper Industries, 81 g sheet). Criterion was set as follows.

As for the burr pushing effect, a case when the burr is pushed by observing the burr by a microscope is indicated as 'O', and a case when the burr is not pushed is indicated as 'X'. Still further, because there is also a problem in terms of conveyance performance such as wrinkles on the sheet, a case when a problem occurs in terms of the conveyance performance such as the sheet wrinkles is evaluated as 'X'. The results may be summarized as shown in Table 1 below.

TABLE 1

| ANGLE θ1 | BURR PUSHING DOWN EFFECT | SHEET WRINKLES |
|---|---|---|
| 0 | X | ○ |
| 5 | ○ | ○ |
| 15 | ○ | ○ |
| 30 | ○ | ○ |
| 45 | ○ | ○ |
| 50 | ○ | X |
| 60 | ○ | X |
| 90 | X | X |

It was unable to obtain the burr pushing effect when the angle θ1 was 0°. It is because the burr pushing roller 50*a*L is not inclined with respect to the sheet conveying direction (direction of the arrow V in FIGS. 5A and 5B).

Still further, it was possible to obtain the burr pushing effect and to suppress the sheet wrinkles from being generated when the angle θ1 was in a range of 5°≤θ1≤45°.

While it was possible to obtain the burr pushing effect when the angle θ1 is in a range of 50° θ1≤θ≤60°, the other problem of the sheet wrinkle has occurred. It occurs because the angle θ1 of the burr pushing roller 50*a*L with respect to the sheet conveying direction was too large, thus applying stress to the sheet P by the rotation of the burr pushing roller 50*a*L and causing the wrinkles as a result.

In a case when the angle θ1 was 90°, it was not able to obtain the burr pushing effect nor the effect of suppressing the sheet wrinkles. Accordingly, it was confirmed that the angle θ1 in disposing the burr pushing roller 50*a*L is preferable to be 5°≤θ1≤45°. That is, if the angle θ1 is switched to the angle θ2, the angle θ2 is preferable to be (5+90)°≤θ2≤(45+90) °.

[Pressurizing Force of Burr Pushing Roller]

Next, an experiment was carried out on a relationship between the pressurizing force of the burr pushing roller pair 50L and the burr pushing effect and the sheet conveying performance. In this experiment, a rotational speed of the burr pushing roller 50*a*L was set at 200 mm/s. The nip width h (see FIG. 4B) in the sheet conveying direction of the burr pushing nip portion N1 was set at 8 mm, a width in the width direction orthogonal to the sheet conveying direction was set at 10 mm, and the angle θ1 of the burr pushing roller 50*a*L was set at 5°. Still further, a type of the sheet P used was GF-0081 (manufactured by Nippon Paper Industries, 81 g sheet).

Still further, the pressurizing force of the burr pushing roller pair 50L was set to be 0.001 to 1 MPa as a contact pressure of the burr pushing nip portion N1 of the burr pushing roller pair 50L. Criterion was set as follows.

As for the burr pushing effect, a case when the burr is pushed by observing the burr by a microscope is indicated as 'O', and a case when the burr is not pushed is indicated as 'X'. Still further, a case when it becomes unable to convey the sheet due to an increase of the pressurizing force of the burr pushing roller pair 50L is evaluated as 'X'. The results may be summarized as shown in Table 2 below.

TABLE 2

| PRESSURIZING FORCE | BURR PUSHING DOWN EFFECT | SHEET CONVEYANCE |
|---|---|---|
| 0.001 | X | ○ |
| 0.005 | X | ○ |
| 0.01 | ○ | ○ |
| 0.05 | ○ | ○ |

TABLE 2-continued

| PRESSURIZING FORCE | BURR PUSHING DOWN EFFECT | SHEET CONVEYANCE |
|---|---|---|
| 0.1 | ○ | ○ |
| 0.5 | ○ | ○ |
| 1 | ○ | X |

The experimental results are verified by substituting numerical values of the experiment in the following formula, i.e., Equation 1, concerning Young's modulus:

$$X=(P\cdot L^3)/(4\cdot b\cdot h^3\cdot E) \quad \text{Eq.1}$$

Where, X denotes a displacement magnitude, P is a stress, L is a length of a beam, b is a width of the beam, h is a thickness of the beam, and E is the Young's modulus.

Figure 6A:
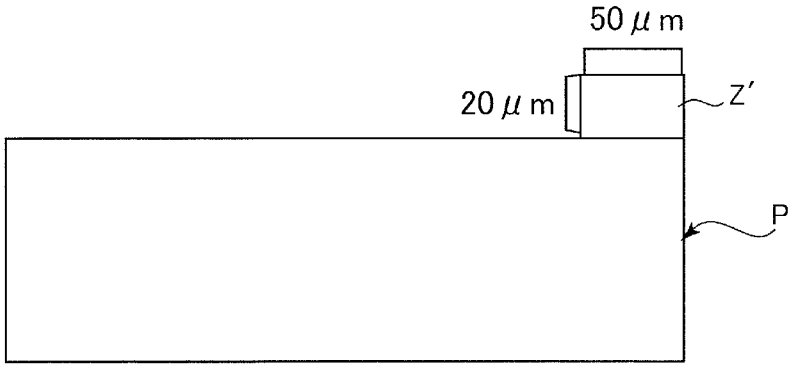
FIG. 6A is a front view diagrammatically illustrating the enlarged burr of the sheet.

Here, the stress P required to push the burr will be calculated. FIG. 6A is a schematic diagram illustrating the burr Z' of the sheet P used in this experiment. The Young's modulus in a bending direction of the sheet P was set at $2\times10^9$ Pa, the length (height) L of the burr Z' (see also FIG. 2) was set at $20\times10^{-6}$ m (20 μm), and the thickness of the burr Z' was set at $50\times10^{-6}$ m (50 μm). Still further, a width b of the burr Z' was set at $10\times10^{-3}$ m with which the burr pushing roller 50*a*L comes in contact, and the displacement magnitude X required to push down the burr Z' was set at $10\times10^{-6}$ m (10 μm).

As a result of the substitution of these values into Equation 1, it was confirmed that the stress P required to push down the burr Z' is 0.01 MPa or more.

It was unable to obtain the burr pushing effect when the contact pressure was less than 0.005 MPa because it was less than the required stress also in the results of the experiment. However, it was possible to pushdown the burr Z' when the contact pressure was 0.01 MPa or more because an enough stress could be applied in terms of the Young's modulus in the bending direction of the sheet P.

However, in a case when the contact pressure was too large, although it was possible to push down the burr Z', the conveyance performance of the sheet P is hampered by the burr pushing nip portion N1 of the burr pushing roller pair 50L, causing conveyance failure when the contact pressure was 1 MPa or more.

[Control System]

Here, a control system of the burr pushing device 36 including the burr pushing roller pairs 50R and SOL of the present embodiment will be described with reference to FIGS. 5A through 8. It is noted that FIG. 8 is a block diagram illustrating the control system of the present embodiment.

Figure 8:
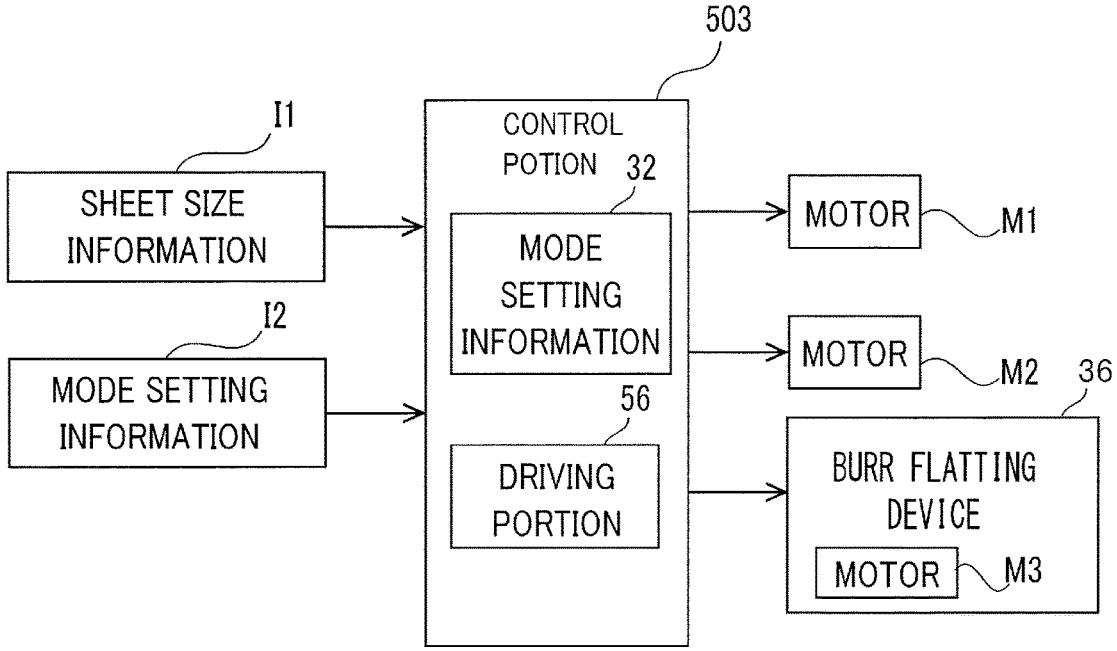
FIG. 8 is a block diagram illustrating a control system.

As shown in FIG. 8, sheet size information I1 indicating positions of the both side edges p1 and p2 of the sheet and mode setting information I2 are inputted to a control portion 503 through an operating portion not shown and included in the printer body 4 or through a personal computer (PC) not shown.

The control portion 503 is also connected with the motor M1 rotationally driving the burr pushing roller 50*a*R of the burr pushing roller pair 50R corresponding to the one side edge p1 of the sheet P in FIG. 5A. Still further, the control portion 503 is connected with the motor M2 rotationally driving the burr pushing roller 50*a*L of the burr pushing roller pair 50L corresponding to the other side edge p2 of the sheet P and with the motor M3 included in the burr pushing device 36 (see FIG. 5A) and causing the set of burr pushing roller pair 50R and 50L to approach to/separate from each other in the width direction.

The control portion 503 includes a mode switching portion 32 and a driving portion 56. The mode switching portion 32 switches a mode based on the sheet size information I1 and the mode setting information I2. The mode switching portion 32 is configured to be able to switch a burr pushing execution mode of implementing the burr pushing process on the sheet P and a burr pushing standby mode in which the burr pushing process is not implemented on the sheet P. The mode switching portion 32 selectively executes either one of these two modes. The driving portion 56 drives the motors M1, M2, and M3.

Still further, the pair of burr pushing rollers 50*a*R and 50*a*L of the burr pushing roller pairs 50R and 50L is disposed on the both sides in the width direction (Q) of the sheet conveying path R in the present embodiment as described above. Then, the pair of burr pushing rollers 50*a*R and 50*a*L is controlled so as to approach to/separate from each other so as to be able to come into contact respectively with the both side edges p1 and p2 of the sheet P corresponding to size of the sheet P conveyed through the sheet conveying path R.

The motor M3 composes a width direction driving portion moving the pair of burr pushing rollers 50*a*R and 50*a*L in the width direction (Q). This motor (the width direction driving portion) M3 is controlled by the control portion 503. That is, the control portion 503 judges whether or not the burr pushing process is to be executed by the pair of burr pushing rollers 50*a*R and 50*a*L based on the mode setting information I2 inputted as described above. Then, when the control portion 503 judges not to execute the burr pushing process, the control portion 503 controls the motor M3 so as to move the pair of burr pushing rollers 50*a*R and 50*a*L to recede positions not being in contact with the both side edges p1 and p2 of the sheet P. Still further, when the control portion 503 judges to execute the burr pushing process, the control portion 503 controls the motor M3 so as to move the pair of burr pushing rollers 50*a*R and 50*a*L to contact positions where the rollers come into contact with the both side edges p1 and p2 of the sheet P.

That is, according to the present embodiment, the burr pushing execution mode and the burr pushing standby mode, selected by the user, are switched by the mode switching portion 32. When the burr pushing execution mode is selected, the mode switching portion 32 controls and drives the motor M3 of the burr pushing device 36 through the driving portion 56. Thereby, the motor M3 of the burr pushing device 36 is actuated and moves the widthwise set of burr pushing roller pairs 50R and 50L to the positions respectively facing the both side edges p1 and p2 in a condition before the sheet P arrives. After the move of the set of burr pushing roller pairs 50R and 50L to the positions respectively facing the both side edges p1 and p2, the driving portion 56 of the control portion 503 rotationally drives the motors M1 and M2.

Meanwhile, in the case when the burr pushing standby mode is selected, the driving portion 56 controls the actuation of the motor M3 of the burr pushing device 36 and moves the widthwise set of burr pushing roller pairs 50R and 50L to positions respectively separated from the both side edges p1 and p2.

Thus, the control portion 503 judges whether or not the burr pushing process is to be executed by the burr pushing roller pairs 50R and 50L based on the mode setting information I2 inputted as described above. Then, when the control portion 503 judges not to execute the burr pushing process, the control portion 503 controls the motor M3 to move the set of burr pushing roller pairs 50R and 50L to the recede positions (positions moved further outward than the positions indicated in FIG. 5A) where the rollers do not come into contact with the sheet side edges.

Still further, in the case when the control portion 503 judges to execute the burr pushing process, the control portion 503 controls the motor M3 so as to move the set of burr pushing roller pairs 50R and 50L to the positions (positions indicated in FIG. 5A) where the rollers come into contact with the sheet side edges. This arrangement makes it possible to readily and steadily control whether or not the burr pushing execution mode is to be executed.

First and Second Comparative Examples

Next, damages and influences exerted on the fixing apparatus by configurations of first and second comparative examples and of the present embodiment will be described. The first comparative example exemplifies a configuration in which a sheet is passed through the fixing apparatus without dealing with burrs.

Figure 6B:
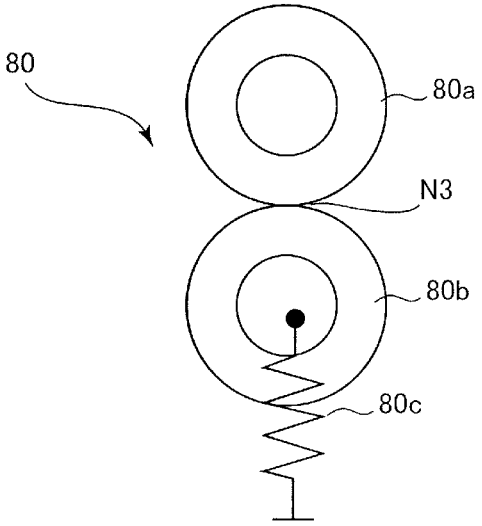
FIG. 6B is a side view diagrammatically illustrating the burr crushing roller used in a second comparative example.

Here, as the second comparative example, a case using a burr crushing roller pair 80 composed of rollers 80*a* and 80*b* as shown in FIG. 6B will be exemplified. The burr crushing roller pair 80 is composed of the columnar roller pair pressing across a widthwise whole range (longitudinal whole range), and a pressure (total pressing force) of 450 kgf is applied by a compression spring 80*c* through the lower roller 80*b*. The burr crushing roller pair 80 is rotated at a predetermined speed by a driving portion not shown.

That is, 450 kgf is applied across the longitudinal whole range (axial direction) of a nip portion N3 of the burr crushing roller pair 80. If a longitudinal width of the nip portion N3 is 300 mm and a nip width in a sheet conveying direction is 1 mm in this case, a contact pressure amounts to about 15 MPa which is an extremely large load as compared to that of the embodiment described above.

In this comparison test, the burr pushing roller pair 50L was used as the present embodiment, and a rotational speed thereof was set at 200 mm/s, a width of the burr pushing nip portion N1 in the sheet conveying direction at 8 mm, and a width in the width direction at 10 mm. Still further, a contact pressure at the burr pushing nip portion N1 was set to be 0.01 MPa and the angle θ1 (see FIG. 5A) by which the burr pushing roller 50*a*L is disposed is set at 5°.

Figure 7:
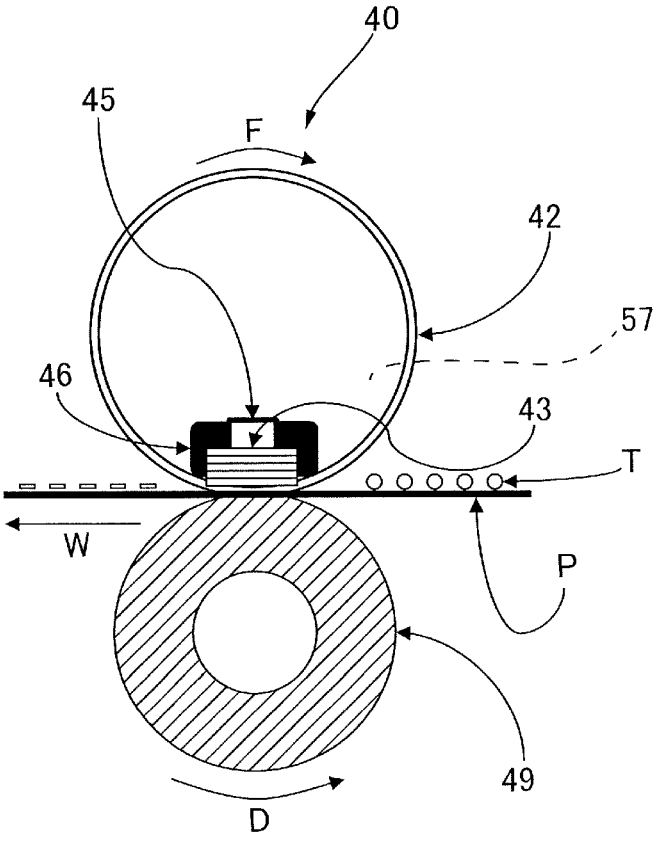
FIG. 7 is a side view diagrammatically illustrating a fixing apparatus.

Comparison conditions were indicated as follows. In this comparison, the operational effect was verified from a scratch speed of a surface layer of the image heating belt 42 in the fixing apparatus 40 (see FIG. 1). It is noted that FIG. 7 is a side view diagrammatically illustrating the fixing apparatus 40 of the present embodiment.

The fixing apparatus 40 includes the cylindrical and heat-resistant image heating belt (fixing belt) 42, i.e., a heating member (fixing member) transmitting heat, a pressure roller 49, and a ceramic heater 43, i.e., a heating body, disposed inside of the image heating belt 42. The ceramic heater 43 is held by a heater holder 46. That is, the cylindrical image heating belt 42 is loosely and outwardly fitted around a support member 47 including the ceramic heater 43. The image heating belt 42 of the present embodiment includes a three-layer composite structure of a surface layer, an elastic layer, and a base layer.

The pressure roller 49 is rotationally driven by a driving portion not shown in a direction of an arrow D at a predetermined circumferential speed. Due to a pressure contact frictional force at a fixing nip portion T between the pressure roller 49 and the image heating belt 42 generated by the rotational drive of the pressure roller 49, a rotational force acts on the image heating belt 42 driven in a direction of an arrow F while adhering on a lower surface of the ceramic heater 43. The support member 47 functions also as a rotation guide member of the cylindrical image heating belt 42.

The fixing apparatus 40 also includes a thermistor (contact-type thermometer) 45 on the ceramic heater 43. The thermistor 45 measure temperature of the image heating belt 42 heated by the ceramic heater 43 and transmits measured results to a temperature control portion not shown.

The speeds of scratches of the surface layer of the image heating belt 42 caused by the sheet side edges were compared in terms of a number of sheets passed through the fixing nip portion T in the technologies of the present embodiment, the first and second comparative examples. A type of the sheet P used was GF-0081 (manufactured by Nippon Paper Industries, 81 g sheet). Criterion was set as follows.

The abovementioned results may be summarized as follows in Table 3. It is noted that the scratch speed was calculated from an inclination of a scratched amount of the image heating belt 42 measured per 100,000 sheets.

TABLE 3

| | CONFIGURATION | SCRACH SPEED | SHEET CONVEYING PERFORMANCE |
|---|---|---|---|
| FIRST COMPARATIVE EXAMPLE | NONE | 2 μm/ 100,000 sheets | ○ |
| SECOND COMPARATIVE EXAMPLE | BURR CRUSHING ROLLER | 0.1 μm/ 100,000 sheets | X |
| PRESENT EMBODIMENT | BURR PUSHING ROLLER | 0.1 μm/ 100,000 sheets | ○ |

As it is apparent from Table 3, the scratch amount was 0.1 μm/100,000 sheets in the present embodiment using the burr pushing roller pair 50L, and the scratch of the surface layer otherwise caused by the burr could be suppressed considerably as compared to 2 μm/100,000 sheets of the comparative example doing nothing to deal with the burrs. Thus, this arrangement of the present embodiment makes it possible to prolong lives of the respective members.

Still further, while the pressure applied to the sheet P was extremely large and there was the problem in terms of the sheet conveying performance in the second comparative example using the burr crushing roller pair 80, the sheet conveying performance could be also assured by the present embodiment using the burr pushing roller pair 50L. Still further, because the contact pressure (nip pressure) of the burr pushing roller pair 50L of the present embodiment is small and hence conveyance resistance is small, it is possible to reduce a driving torque and to downsize the apparatus. Thus, the use of the present embodiment makes it possible to considerably suppress the scratch of the member otherwise caused by the burrs while improving the sheet conveying performance and downsizing the apparatus.

As described above, according to the present embodiment, it is possible to push down the burrs Z (Z') on the side edges of the sheet P conveyed thereto in the width direction by the burr pushing rollers (the burr pushing portion) 50*a*R and 50*a*L disposed at least one side of the width direction (direction of the arrow Q). Therefore, it is not necessary to apply an extremely large force to the sheet side edges to crush the burrs. Then, it becomes unnecessary to increase the torque of the driving rollers and others for conveying the sheet. Still further, the present embodiment requires no such configuration of removing paper powder by blowing air within the sheet conveying apparatus and enables to effectively reduce the burrs Z (Z') of the sheet P without enlarging the apparatus or increasing its cost.

Second Embodiment

Figure 11:
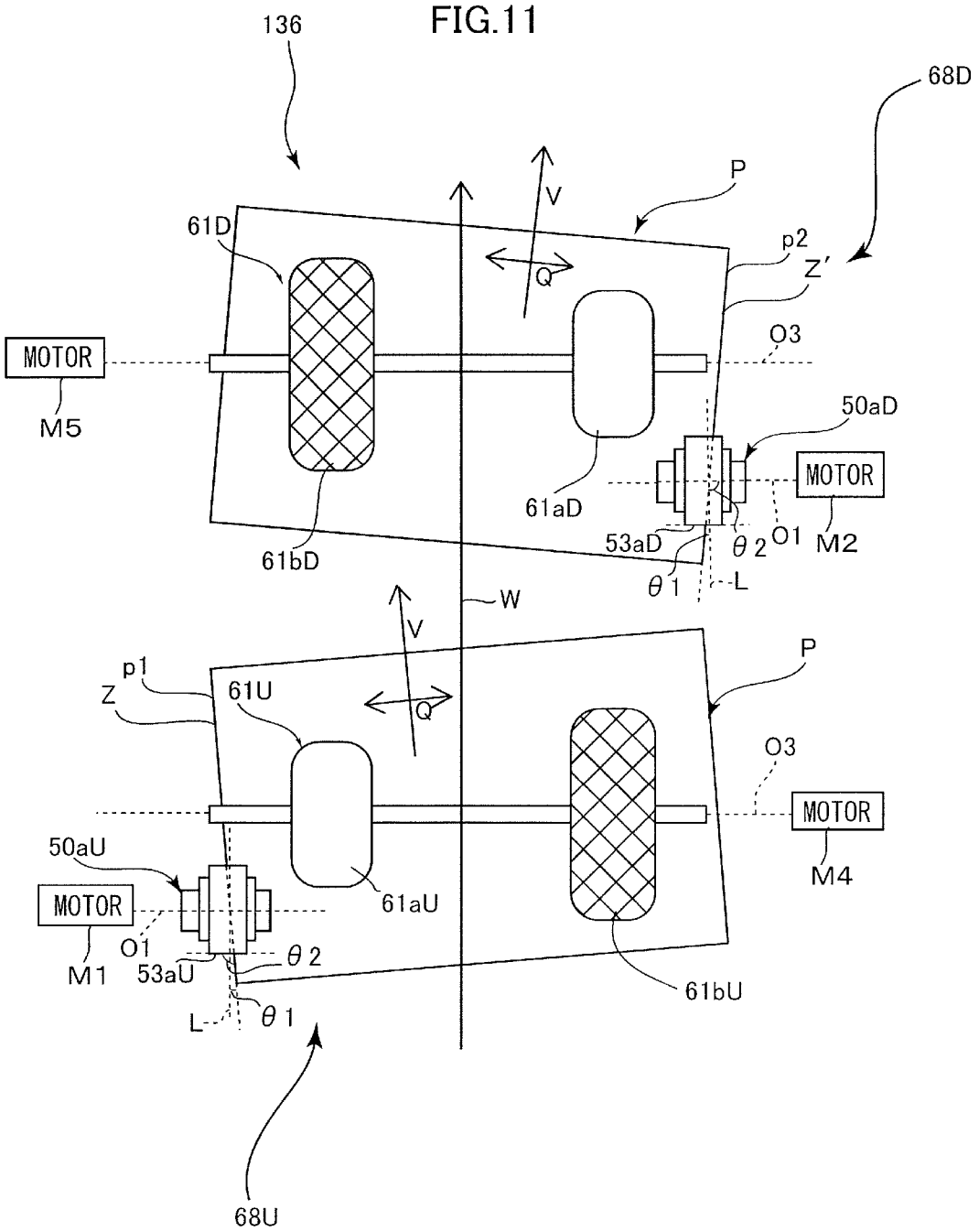
FIG. 11 is a plan view diagrammatically illustrating a positional relationship between the conveying roller and the burr pushing roller.

Next, a second embodiment of the present invention will be described with reference to FIGS. 9A through 11. It is noted that in the present embodiment, the same or corresponding members with those of the first embodiment will be denoted by the same reference numerals, and a description of those members having the same configuration and function will be omitted here. According the present embodiment, burr pushing roller pairs 50U and 50D constructed in the same manner with the burr pushing roller pairs 50R and 50L described in FIGS. 4A and 4B are disposed so as to locate upstream and downstream of an extension direction (W) of the sheet conveying path R as shown in FIG. 11.

While the burr pushing roller pair is positioned in the condition in which the burr pushing roller pair is inclined in advance by the angle θ2 (θ1) with respect to the sheet conveyed thereto, the burr pushing roller pair 50U and 50D is configured as follows in FIG. 11 in a plan view in the present embodiment. That is, as shown in FIG. 9B, axes of rotation O1 of the burr pushing rollers 50*a*U and 50*a*D are supported orthogonally to a direction in which the sheet conveying path R extends (direction of an arrow W). That is, the burr pushing rollers 50*a*U and 50*a*D are composed respectively of cylindrical rollers rotating centering on the axes of rotation O1, which are in parallel with the width direction, while in contact respectively with the sheet side edges p1 and p2. Then, the burr pushing rollers 50*a*U and 50*a*D are configured such that the burr pushing rollers 50*a*U and 50*a*D come into contact with the side edges p1 and p2 of the sheet P, while inclining by the predetermined angle θ2 (θ1), conveyed thereto while being inclined by a conveying roller pair 60U and 60D, driven by motors M4 and M5, with respect to outer circumferential surfaces 53U and 53*a*D of the burr pushing rollers 50*a*U and 50*a*D.

As shown in FIGS. 9A through 11, a burr pushing device 136 of the present embodiment includes a first burr pushing portion 68U disposed upstream of the extension direction of the sheet conveying path R and a second burr pushing portion 68D disposed downstream. The first burr pushing portion 68U includes the burr pushing roller pair 50U having the outer circumferential surface 50*a*U, i.e., a first contact portion or a first outer circumferential surface, and the conveying roller pair 60U, i.e., a conveying portion or a first conveying portion. The second burr pushing portion 68D includes the burr pushing roller pair 50D having the outer circumferential surface 53*a*D, i.e., a second contact portion or a second outer circumferential surface, and the conveying roller pair 60D, i.e., a second conveying portion. The conveying roller pair 60U and 60D determining approach angles of the sheet P to the widthwise set of respective burr pushing roller pairs 50U and 50D are disposed so as to be located slightly downstream of the respective burr pushing rollers 50*a*U and 50*a*D upstream and downstream of the extension direction (W). It is noted that the conveying roller pair 60U and 60D are located symmetrically widthwise about a line at the conveyance center, so that only the conveying roller pair 60D will be described in the following description and a description of the conveying roller pair 60U will omitted.

Figure 9A:
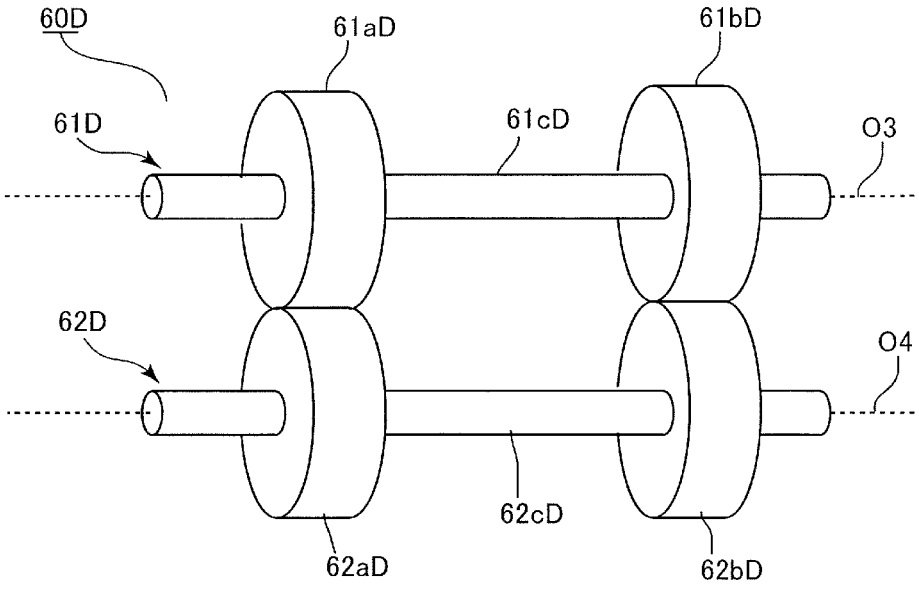
FIG. 9A is a perspective view diagrammatically illustrating a conveying roller pair according to a second embodiment.
Figure 9B:
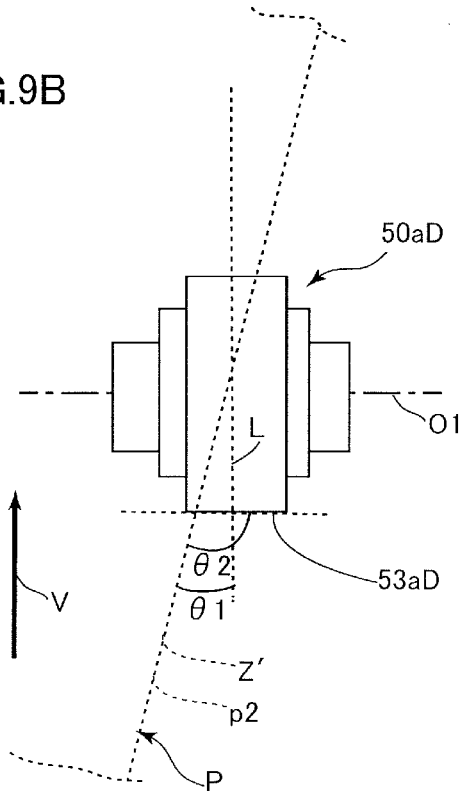
FIG. 9B is a plan view diagrammatically illustrating a part where the burr pushing roller comes into contact with the side edge of the sheet.
Figure 10:
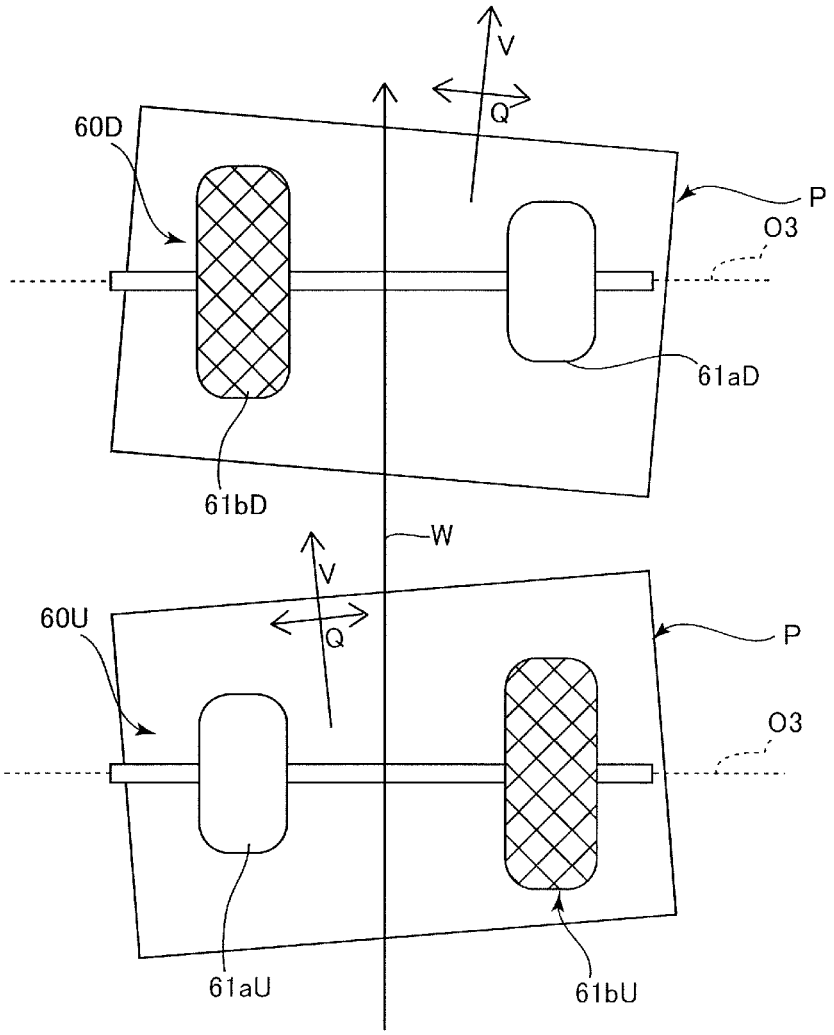
FIG. 10 is a plan view diagrammatically illustrating a condition in which a sheet is conveyed aslant by conveying rollers provided upstream and downstream.

As shown in FIG. 9A, the burr pushing roller pair 60D includes upper and lower conveying rollers 61D and 62D disposed to face with each other. These conveying rollers 61D and 62D rotate respectively centering on axes of rotation O3 and O4.

The upper conveying roller 61D includes a first small driving roller (first rotor) 61*a*D coaxially fixed and supported by an axial member 61*c*D and a second driving roller (second rotor) 61*b*D larger than the first driving roller 61*a*D. The lower conveying roller 62D includes a first driven roller 62*a*D having the same diameter (small) with the first driving roller 61*a*D and a second driven roller 62*b*D having the same diameter (large) with the second driving roller 61*b*D.

It is noted that the positional relationship between the burrs Z and Z' formed on the sheet side edges p1 and p2 and the burr pushing rollers 50*a*U and 50*a*D is the same with that described in the first embodiment, so that its description will be omitted here.

The conveying roller pair 60U and 60D constructed as described above compose first and second conveying portions conveying the sheet P while inclining with respect to the extension direction of the sheet conveying path R. The conveying roller pair 60D conveys the sheet P while inclining the sheet by a difference of conveying speeds caused by a difference of outer diameters of the first and second driving rollers 61*a*D and 61*b*D. The diameter of the first driving roller 61*a*D is set to be smaller than that of the second driving roller 61*b*D by about 5%.

Specifically, a SUS material is adopted for the axial members 61*c*D and 62*c*D of the conveying roller pair 60D and an elastic layer is adopted for the first and second driving rollers 61*a*D and 61*b*D. Then, the diameter of the small first driving roller 61*a*D is set at 20 mm, and the diameter of the large second driving roller 61*b*D is set at 21 mm. These conveying rollers 61D and 62D are disposed as a roller pair so as to be able to face upper and lower surface of the sheet P. It is noted that it is a matter of course that the conveying roller pair 60U has the same construction with the conveying roller pair 60D.

The pair of burr pushing rollers 50*a*U and 50*a*D disposed on the widthwise both sides of the sheet conveying path R is controlled so as to be able to approach to/separate from each other so as to be able to come into contact the both sides of the sheet corresponding to size of the sheet P conveyed through the sheet conveying path R also in the present embodiment. Then, the actuation of the pair of burr pushing rollers 50*a*U and 50*a*D is controlled in the same manner with the first embodiment by the control portion 503 shown in FIG. 8.

The widthwise pair of burr pushing rollers 50*a*U and 50*a*D of the present embodiment is disposed separately upstream and downstream of the extension direction of the sheet conveying path R in a plan view in FIG. 11. However, basically the pair of burr pushing rollers 50*a*U and 50*a*D is actuated so as to approach to/separate from each other widthwise by the motor M3, i.e., the widthwise driving portion shown in FIG. 8, by using a similar mechanism, e.g., a rack-and-pinion, with that of the burr pushing device 36 of the first embodiment. The control portion 503 of the present embodiment controls the motors M4 and M5 respectively rotationally driving the upstream and downstream conveying rollers 61U and 61D in addition to the configuration shown in FIG. 8.

The control portion 503 judges whether or not the burr pushing process is to be executed based on the mode setting information I2, and in the case when the burr pushing process is not to be executed, controls the motor M3 so as to move the pair of burr pushing rollers 50*a*U and 50*a*D to recede positions where the rollers do not come into contact with the sheet both side edges also in the present embodiment. In the case when the control portion 503 judges to execute the burr pushing process, the control portion 503 controls the motor M3 so as to move the pair of burr pushing rollers 50*a*U and 50*a*D to contact positions where those rollers come into contact with the both side edges of the sheet.

After moving the widthwise set of burr pushing roller pairs 50U and 50D to the positions where they can face respectively with the both side edges p1 and p2, the driving portion 56 of the control portion 503 rotationally drives the motors M1 and M2, respectively. Still further, the driving portion 56 drives the motor M4 to convey the sheet while inclining to the left side in FIG. 11 such that one side edge p1 is in sliding contact with the left burr pushing roller 50*a*U.

It is noted that because the burr pushing roller 50*a*U is disposed upstream in the conveying direction of the conveying roller 61U in the present embodiment, the sheet P enters the burr pushing roller 50*a*U straightly without inclining in the beginning. This arrangement makes it possible for the burr pushing roller 50*a*U to reliably nip the burrs Z formed at the side edge p1 of the sheet P. Then, in response to nipping of the sheet by the conveying roller 61U, the sheet P is conveyed while gradually inclining counterclockwise in FIG. 11, so that the burrs Z are pushed by the burr pushing roller 50*a*U. It is noted that the burr pushing roller 50*a*U may be disposed downstream, in the sheet conveying direction, of the conveying roller 61U.

Then, the driving portion 56 drives the motor M5 to convey the sheet while inclining toward the right side in FIG. 11 such that the other side edge p2 comes into sliding contact with the right burr pushing roller 50*a*D. In this case, on the upstream side, the sheet P conveyed by the second driving roller 61*b*U moves in a condition in which the conveying speed is large by 5% on the right side, and on the downstream side, the sheet P conveyed by the second driving roller 61*b*D moves in a condition in which the conveying speed is large by 5% on the left side (see also FIG. 10).

While comparisons and verifications were made also in the present embodiment by using the first and second comparative examples and the embodiment, results were the same with the contents described in the first embodiment. Thus, it is possible to obtain the similar operational effects with the first embodiment also in the present embodiment described above.

Third Embodiment

Figure 13:
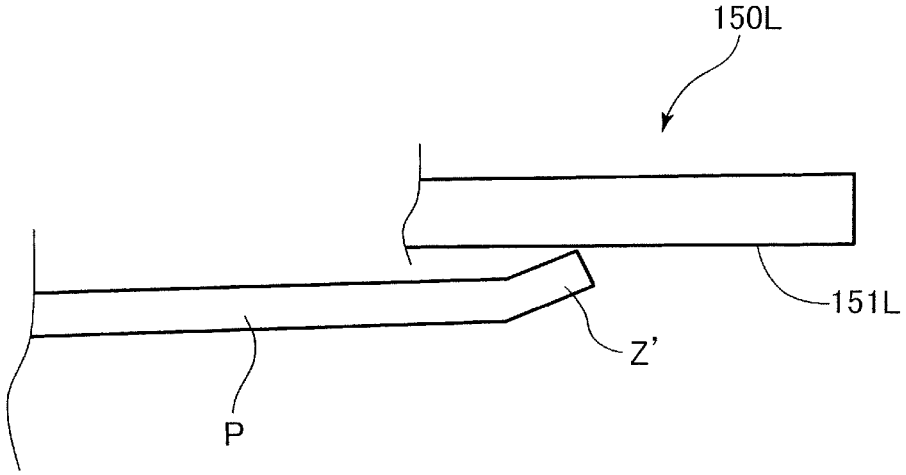
FIG. 13 is a front view illustrating a guide member pushing down a burr outward.
Figure 14:
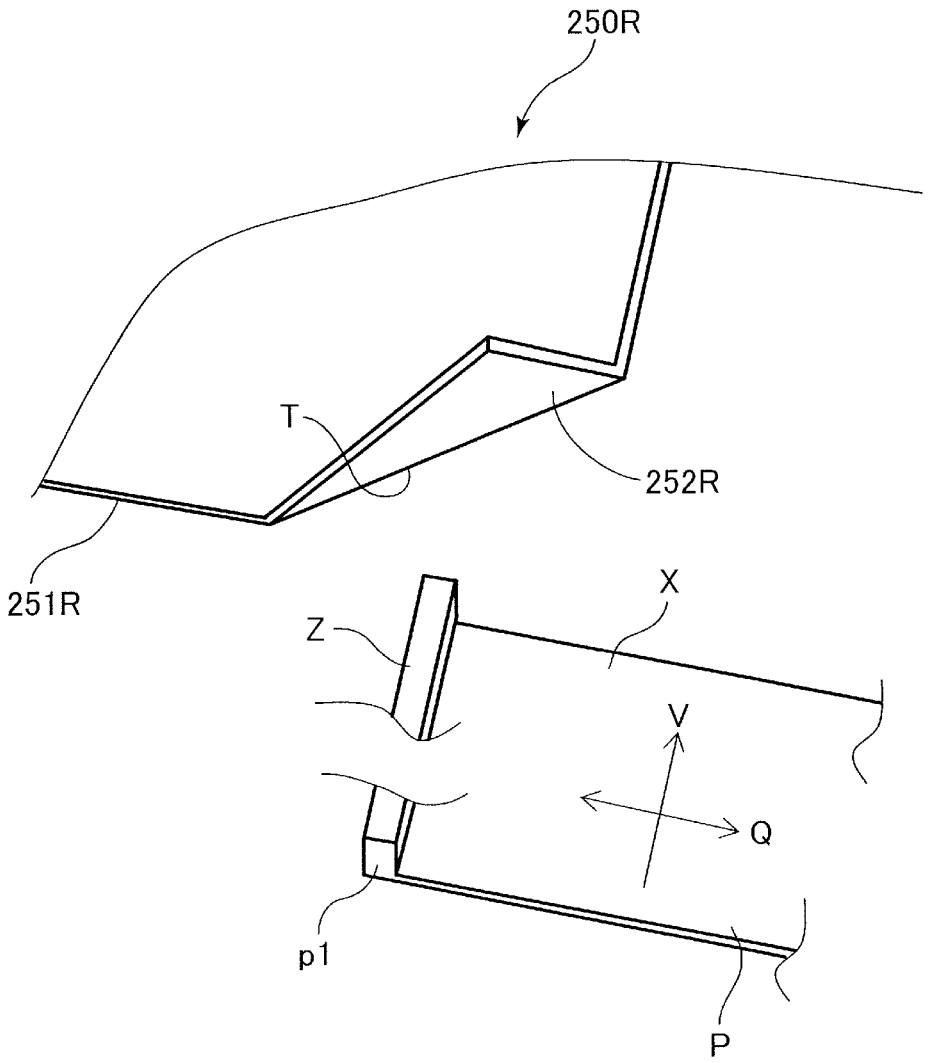
FIG. 14 is a perspective view illustrating a guide member according to a modified example of the third embodiment.

Next, a third embodiment of the present invention will be described with reference to FIGS. 12 through 14. A burr pushing device 236 of the present embodiment is what the configuration of the burr pushing roller pairs 50R and 50L of the first embodiment is modified, and other configurations are the same with those of the first embodiment. Therefore, only a guide member 150L having the same function with the burr pushing roller pair 50L of the first embodiment will be described below.

Figure 12:
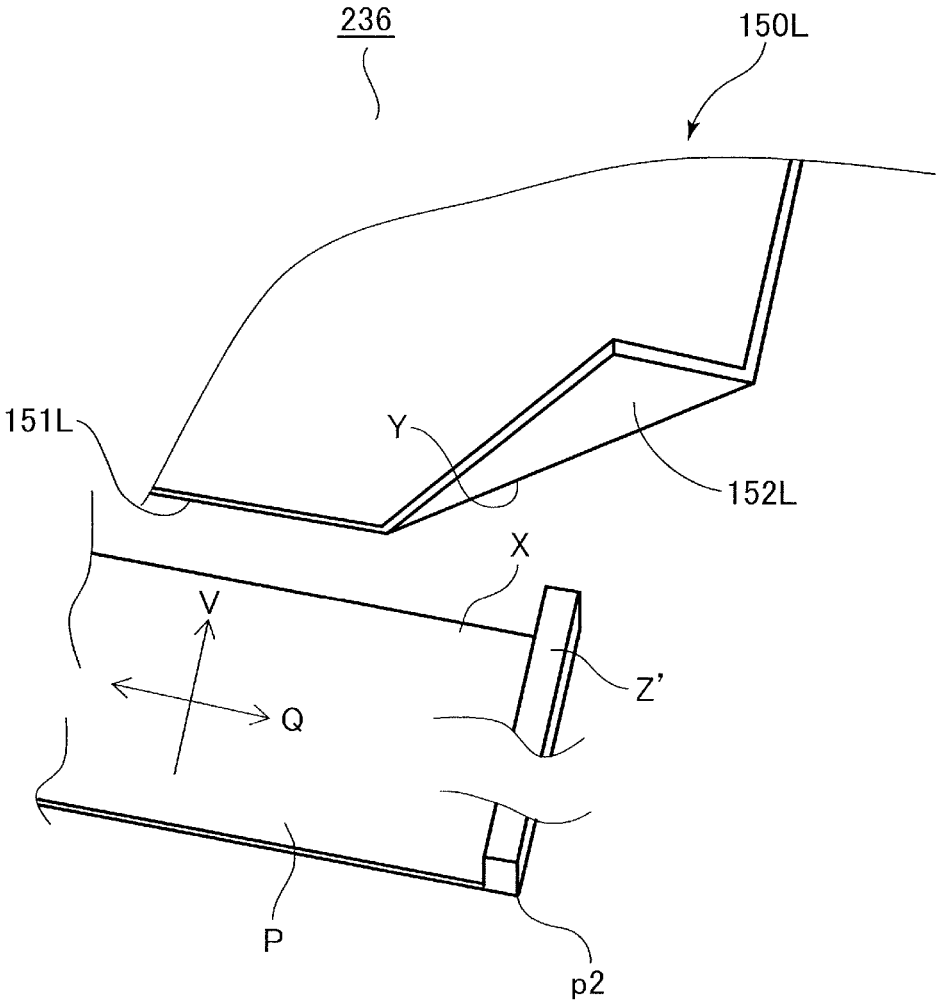
FIG. 12 is a perspective view illustrating a guide member of a third embodiment.

As shown in FIG. 12, the guide member 150L (burr pushing portion) includes a guide surface 151L facing a surface X of the sheet P conveyed thereto and a pushing surface 152L formed continuously from the guide surface 151L. The pushing surface 152L, i.e., a contact portion, is formed by bending a guide surface 151L in a direction separating from the surface X of the sheet P by a line Y inclined with respect to the sheet conveying direction V and to the width direction Q. More specifically, the line Y is inclined aslant so as to be distant from the center of the sheet conveying path R from the upstream side toward the downstream side of the sheet conveying direction.

The pushing surface 152L is disposed at the position corresponding to the other side edge p2 of the sheet conveyed in the sheet conveying direction V, and the guide surface 151L is formed continuously downstream of the pushing surface 152L in the sheet conveying direction V. A very small space not influential on the conveyance of the sheet P is provided between the guide surface 151L and the surface X of the sheet P. The burrs Z' of the sheet P are formed to be higher than the very small space.

In response to the conveyance of the sheet P, the burrs Z' formed at the side edge p2 come into contact with the pushing surface 152L. At this time, the pushing surface 152L are in contact with the burr Z' while inclining with respect to the side edge p2 of the sheet P in a plan view. Therefore, as the sheet P passes by, the burr Z' is pushed widthwise to the outside of the sheet by the pushing surface 152L. Then, as shown in FIG. 13, the sheet is guided in the sheet conveying direction V while keeping the condition in which the burr Z' is pushed by the guide surface 151L. Because the condition in which the burr Z' is pushed is kept until when the sheet P passes through the guide member 150L, it is possible to reliably push down the burr Z' in the width direction.

It is noted that while the guide member 150L pushing down the burr Z' formed at one (left for example) side edge p2 of the sheet has been described in the present embodiment, it is also possible to provide two guide members to push down the burrs Z and Z' on both side edges p1 and p2 of the sheet like the first embodiment.

Modified Example

Figure 15:
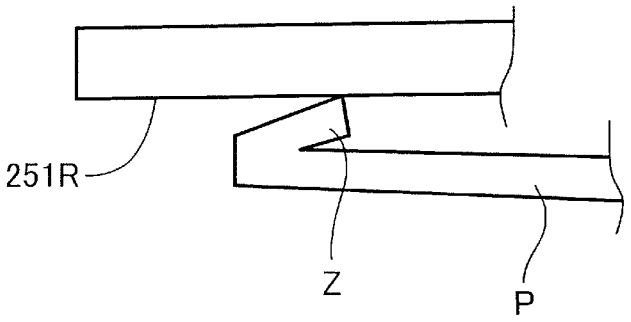
FIG. 15 is a front view illustrating the guide member pushing down the burr inward.

Next, a modified example of the third embodiment will be described with reference to FIGS. 14 and 15. As shown in FIGS. 14 and 15, a guide member 250R of this modified example includes a pushing surface 252R at a position corresponding to one side edge p1 of the sheet. The pushing surface 252R is formed such that the burr Z is pushed inward of the sheet.

That is, the pushing surface 252R is formed by bending a guide surface 251R in a direction separating from the surface X of the sheet P by a line T inclined with respect to the sheet conveying direction V and the width direction Q. Specifically, the line T is inclined downstream of the sheet conveying direction V toward the sheet conveyance center. Thereby, the burr Z is pushed inward of the sheet in the width direction by the pushing surface 252R as the sheet P passes by.

It is noted that while the first and second embodiments described above have been constructed such that the burrs are pushed outward of the sheet, they may be configured such that the burrs are pushed inside of the sheet. That is, while the burr pushing roller is disposed so as to incline upstream of the sheet conveying direction as the axis of rotation heads toward the sheet conveyance center in the first embodiment, the burr pushing roller may be disposed so as to incline downstream. Still further, it is possible to configure the second embodiment by switching the disposition of the small first driving roller with that of the large driving roller of the conveying roller pair.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-208959, filed Oct. 10, 2014, which is hereby incorporated by reference herein in its entirety.

What is claimed is:

1. A sheet conveying apparatus, comprising:

a sheet conveying portion configured to convey a sheet;

a sheet conveying path through which the sheet conveyed by the sheet conveying portion is conveyed; and a burr pushing roller having a cylindrical shape and configured to rotate on an axis of rotation, the burr pushing roller being positioned on the sheet conveying path and pushing down a burr at one side edge of the sheet in a width direction orthogonal to a sheet conveying direction of the sheet, wherein the axis of rotation is offset with respect to the width direction orthogonal to the sheet conveying direction such that the axis of rotation is further upstream in the sheet conveying direction as the axis of rotation extends toward to a center of the sheet conveying path in the width direction orthogonal to the sheet conveying direction, and the axis of rotation is further downstream in the sheet conveying direction as the axis of rotation extends away from the center of the sheet conveying path in the width direction orthogonal to the sheet conveying direction.

2. The sheet conveying apparatus according to claim 1, wherein the burr pushing roller is a first burr pushing roller, the axis of rotation is a first axis of rotation, the sheet conveying apparatus further comprises a second burr pushing roller configured to rotate centering on a second axis of rotation and formed into a cylindrical shape, the second burr pushing roller portion pushing down a burr, formed on another side edge opposite to the one side edge where the burr is pushed down by the first burr pushing roller, outward of the sheet in the width direction, and the second axis of rotation is inclined with respect to the width direction such that an upstream side, in the sheet conveying direction, of the second axis of rotation is closer to the center of the sheet conveying path than a downstream side, in the sheet conveying direction, of the second axis of rotation.

3. An image forming apparatus, comprising:

a sheet conveying apparatus as set forth in claim 1; and an image forming portion configured to form an image on a sheet conveyed by the sheet conveying apparatus.

4. A sheet conveying apparatus comprising:

a sheet conveying portion configured to convey a sheet;

a sheet conveying path through which the sheet conveyed by the sheet conveying portion is conveyed; and a roller positioned to push down a burr on the sheet at one side edge of the sheet conveying path in a width direction orthogonal to a sheet conveying direction, wherein an axis of rotation of the roller is parallel with the width direction orthogonal to the sheet conveying direction, and a radius of the roller decreases along the axis of rotation as the axis of rotation extends from an inner end in the width direction orthogonal to a sheet conveying direction toward to an outer end further from a center of the sheet conveying path in the width direction orthogonal to a sheet conveying direction than the inner end.

* * * * *